US010274273B1

(12) United States Patent
Potter

(10) Patent No.: US 10,274,273 B1
(45) Date of Patent: Apr. 30, 2019

(54) PROCESS OF MAKING A GAS OPERATED FIREARM BARREL

(71) Applicant: Garrett Weston Potter, Apopka, FL (US)

(72) Inventor: Garrett Weston Potter, Apopka, FL (US)

( * ) Notice: Subject to any disclaimer, the term of this patent is extended or adjusted under 35 U.S.C. 154(b) by 0 days.

(21) Appl. No.: 15/983,497

(22) Filed: May 18, 2018

Related U.S. Application Data

(60) Provisional application No. 62/603,383, filed on May 30, 2017.

(51) Int. Cl.
*F41A 5/26* (2006.01)
*F41A 21/00* (2006.01)

(52) U.S. Cl.
CPC ..... *F41A 5/26* (2013.01); *F41A 21/00* (2013.01)

(58) Field of Classification Search
CPC .... F41A 5/28; F41A 21/00; F41A 5/18; F41A 5/24; F41A 5/26
USPC ..... 89/193
See application file for complete search history.

(56) References Cited

U.S. PATENT DOCUMENTS 2,582,989 A * 1/1952 Harvey ..... F41A 5/26 89/191.01
3,478,417 A * 11/1969 Shaw ..... F41A 21/36 29/558
3,657,960 A * 4/1972 Badali ..... F41A 5/18 89/191.02
4,414,880 A * 11/1983 Throner ..... F41A 5/28 89/193
4,901,623 A * 2/1990 Lee ..... F41A 5/26 89/191.02
5,388,500 A * 2/1995 Petrovich ..... F41A 3/62 89/129.01
5,844,162 A * 12/1998 Renner ..... F41A 21/18 89/14.3
6,382,073 B1 * 5/2002 Beretta ..... F41A 5/26 89/191.01
6,619,592 B2 * 9/2003 Vignaroli ..... F41A 5/18 89/191.01
7,448,307 B1 * 11/2008 Dafinov ..... F41A 5/26 89/191.01
8,245,625 B2 * 8/2012 Winge ..... F41A 5/26 89/191.01
8,596,185 B1 * 12/2013 Soong ..... F41A 5/28 89/193
2012/0137870 A1 * 6/2012 Lindsay ..... F41A 1/10 89/191.01
2016/0161200 A1 * 6/2016 Windauer ..... F41A 5/28 89/193
2016/0202012 A1 * 7/2016 Kokinis ..... F41A 5/26 89/193

* cited by examiner

*Primary Examiner* — Joshua E Freeman
(74) *Attorney, Agent, or Firm* — William M. Hobby, III

(57) ABSTRACT

A gas operated firearm barrel has a gas port angled through the wall thereof at an angle from adjacent the barrel muzzle rearward to the barrel bore to thereby allow the shortening of the barrel while maintaining the distance of the gas port bore opening from the barrel muzzle. The process of making a gas port in a barrel in accordance with the present invention is also taught.

5 Claims, 3 Drawing Sheets

PROCESS OF MAKING A GAS OPERATED FIREARM BARREL

This application claims the benefit of U.S. Provisional Application No. 62/603,383, filed May 30, 2017.

FIELD OF THE INVENTION

This invention relates to a barrel for a gas operated firearm barrel and especially to a gas operated firearm having an angled gas port extending from the barrel bore opening towards the barrel muzzle and to a method of making an angled barrel gas port.

BACKGROUND OF THE INVENTION

A gas operated autoloading firearm uses a portion of the gas from the cartridge being fired to power the mechanism to extract the spent case and insert a new cartridge into the rifle chamber. Energy from the gas is generally collected through a port in the firearm barrel. The high-pressure gas may impinge upon a piston head or "gas key" to provide the motion for unlocking the firearm action, extract and eject the spent case while cocking the hammer and having a spring return chambering a new cartridge of the firearm and locking the action. The gas port in the barrel needs to be placed a sufficient distance from the end of a barrel in order to obtain the desired pressure and time in the gas port for completing the extraction of the cartridge before the bullet leaves the end of the barrel.

Gas operated firearms commonly use either a solid gas piston or hollow "gas tube" driven by the combustion gas from a port in the firearm barrel near the muzzle of the barrel. The barrel is the same for both types. The port size and distance from the end of the barrel needs to be tuned for the operating parts and spring pressure. Many firearms, such as the AK-47, use a long-stroke piston system in which the piston is mechanically fixed to the bolt assembly and moves through the entire operating cycle. A short stroke system moves the piston separately from the bolt assembly. A direct impingement uses a hollow gas tube which allows gases to travel through it and the gas pushes on a gas key and unlocking the bolt.

The present invention is for a gas operated firearm barrel having a gas port angled through the wall thereof at an angle from adjacent the barrel muzzle rearward to the barrel bore to thereby allow the shortening of the barrel while maintaining the distance of the gas port bore opening from the barrel muzzle. The process of making a gas port in a barrel in accordance with the present invention is also taught.

SUMMARY OF THE INVENTION

This invention relates to a gas operated firearm and especially to a gas operated firearm barrel having a gas port angled rearward from the barrel muzzle towards the gas port barrel bore to thereby allow the shortening of the barrel while maintaining the distance of the gas port opening in the barrel bore from the barrel muzzle. The process of making an angled gas port in a barrel in accordance with the present invention is also taught.

A barrel for a gas operated firearm has a firearm barrel having a bore therethrough and a muzzle at one end thereof. An elongated gas port is formed through the firearm barrel wall having a gas port barrel bore opening in the bore wall thereof a predetermined distance from the firearm barrel muzzle. The gas port extends through the firearm barrel wall at a predetermined angle from adjacent the firearm barrel muzzle to the barrel bore. The gas port connects to a firearm operating gas tube near the firearm barrel muzzle. The firearm barrel may thus be shortened while maintaining a gas port bore opening a set operating distance from the firearm barrel muzzle and providing an increased dwell time.

A process of making a firearm barrel for a gas operated firearm includes selecting a barrel for a gas operated firearm having a bore therethrough and a muzzle. A barrel drill jig for holding a barrel therein has a barrel attached thereto and is adjustably attached at an angle to a drill press or CNC mounting fixture which mount with barrel drill jig is attached to a drill bit table. A drill bit is selected of a predetermined size for drilling an angled gas port in the firearm barrel held in the barrel jig held at a predetermined angle on the drill press mount. A gas port is drilled with the drill press or CNC into the firearm barrel at a predetermined angle with the predetermined drill bit from adjacent the barrel muzzle rearwardly toward the firearm barrel bore to position the gas port firearm bore opening a predetermined distance from the barrel muzzle.

BRIEF DESCRIPTION OF THE DRAWINGS

The accompanying drawings, which are included to provide further understanding of the invention, are incorporated in and constitute a part of the specification and illustrate an embodiment of the invention and together with the description serve to explain the principles of the invention.

In the drawings.

DETAILED DESCRIPTION OF AN EXEMPLARY EMBODIMENT

Figure 1:
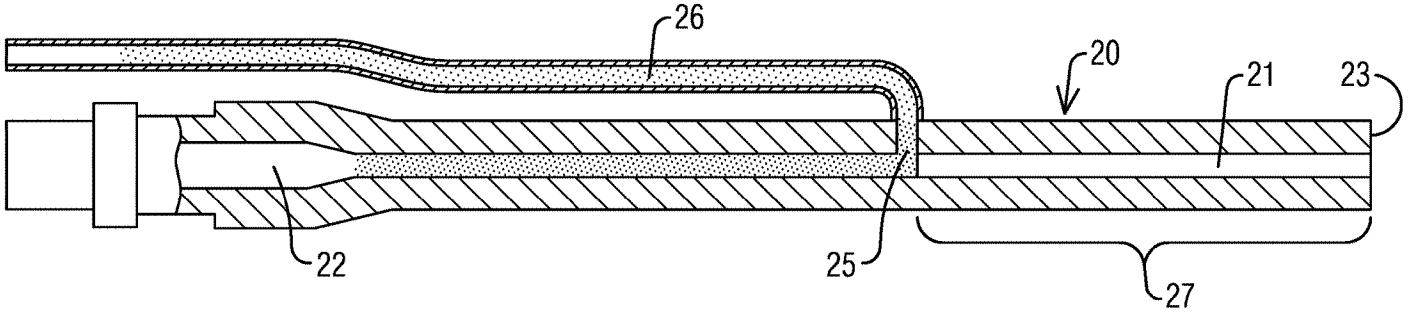
FIG. 1 PRIOR ART
FIG. 1 is a sectional view of a prior art gas operated rifle barrel.

FIG. 1 of the drawings shows the operation of a typical gas operated rifle in which the rifle barrel 20 has a bore 21 extending from a chamber 22 to the muzzle 23. A 90 degree gas port 25 directs the pressured gas from the bullet passing through the bore 21 thereinto once the bullet passes the gas port opening and before passing out the muzzle 23. After the bullet passes from the muzzle 23, the pressured gas in the bore drops and allows the bolts to chamber a new cartridge. Thus the gas port 25 and gas tube 26 are pressurized only during the time the bullet passes the gas port 25 opening and leaves the muzzle 23. This distance must be of sufficient length to allow the gas operated mechanism to drive the bolt to extract the spent casing and short enough to allow the bolt to insert the new cartridge. This distance 27, typically requiring about 1.5 inches in front of the gas port 25 opening, is required for the rifle barrel to have enough length to allow the gas operating mechanism to complete its operation. Without this distance, the gas port would have to be too large to make the system cycle the bolt carrier and would violently sling the bolt carrier back.

Figure 2:
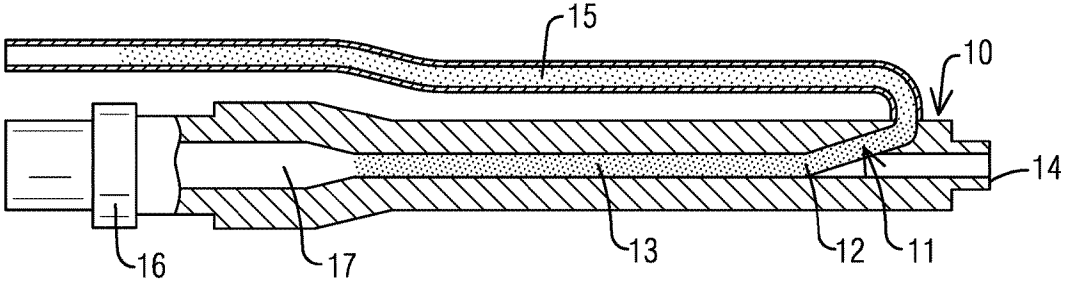
FIG. 2 is a sectional view of a gas operated rifle barrel in accordance with the present invention.
Figure 3:
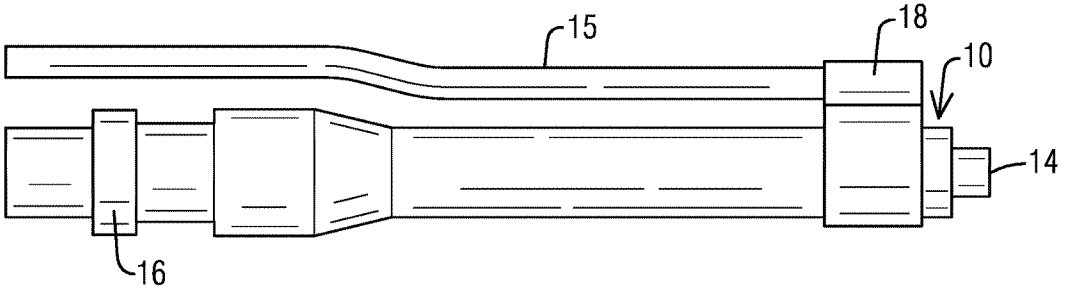
FIG. 3 is an elevation of the gas operated rifle barrel in accordance with FIG. 2 having the gas block mounted for holding the gas tube at the gas port.

The present invention as seen in FIGS. 2 and 3 is for a gas operated firearm having a gas operated firearm barrel 10 having the gas port 11 angled from the gas port opening 12 in the barrel bore towards the barrel muzzle 14. This allows for the shortening of the barrel 10 while maintaining the distance between the gas port opening 12 in the barrel bore 13 and the barrel muzzle 14 to maintain the gas pressure in the gas port 11 and in a standard length gas tube 15 to power the bolt 16 to extract a spent cartridge case from the chamber 17 and insert a new cartridge therein. The barrel is used on a rifle with a standard length gas tube 15 with a standard diameter and height gas block. The gas port opening 12 is positioned to allow enough distance between the port opening and the muzzle 14 allowing a shorter barrel 10 while increasing dwell time and gas pressure. It also allows for a smaller gas port of 10 to 20 thousandths of an inch compared to a 90 degree gas port and reduces recoil and muzzle climb in the rifle. The shortened barrel length is accomplished without the aid of a muzzle brake or other recoil reducing device but a muzzle brake does make the rifle response smoother. FIG. 3 shows the barrel 10 having the gas block 18 mounted thereto. The gas block 18 slides over the barrel 10 and is held on by set screws or clamp screws, or the like, and is used to change the direction of the gas flow and pressure 90 degrees from exiting the rifle barrel 10 gas port 11 into the gas tube 15. The present rifle barrel gas port system cycles the gas system and bolt carrier properly with a smaller gas port than a traditional semi-automatic recoil reduction to provide a better recoil control in the rifle. The present improved barrel has been shown to function correctly with different length barrels and even with a pistol length barrel having a gas operated system.

Figure 4:
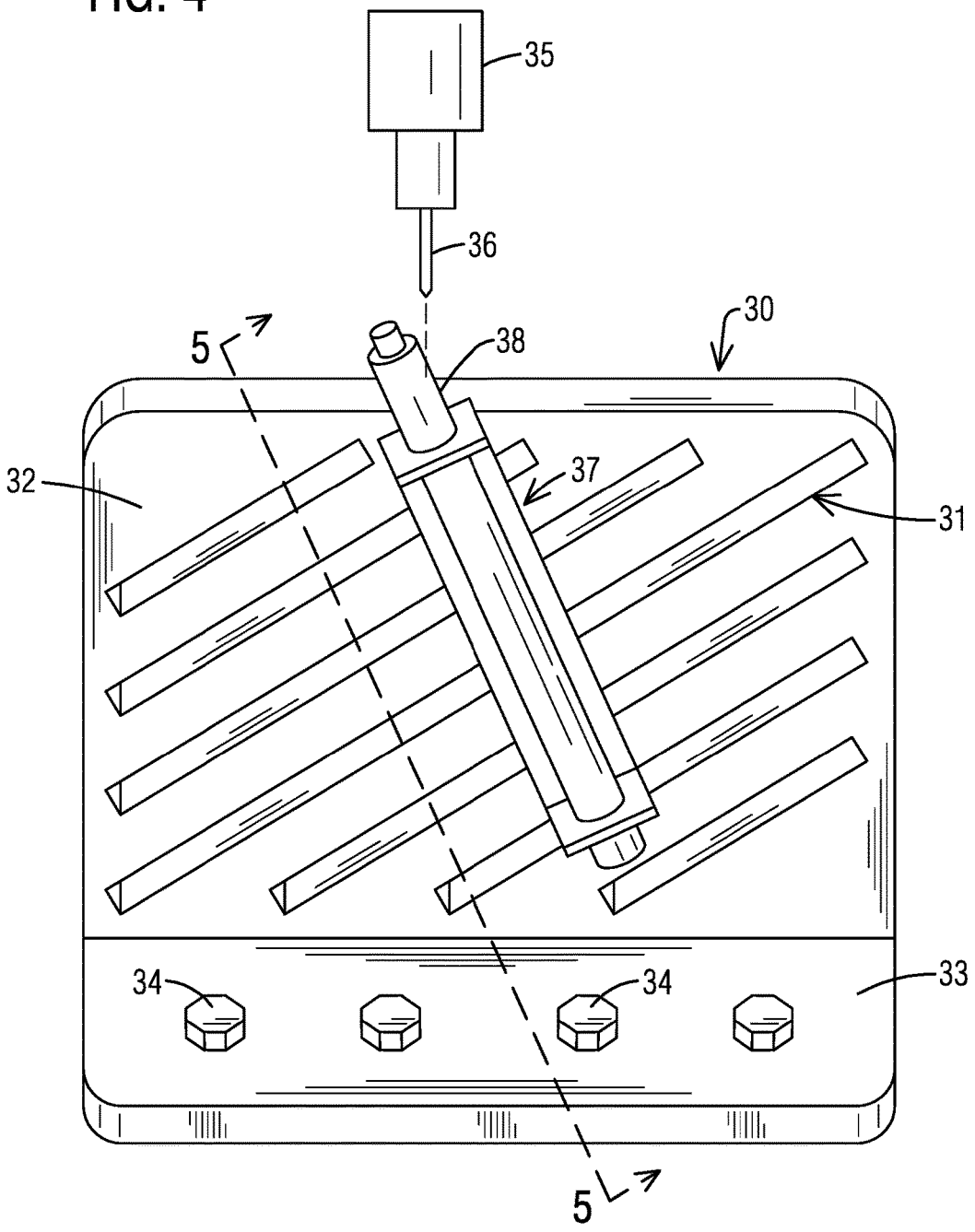
FIG. 4 is a perspective view of a jig for holding a rifle barrel attached to a drill press fixture or mount for drilling a rifle barrel in accordance with the present invention.
Figure 5:
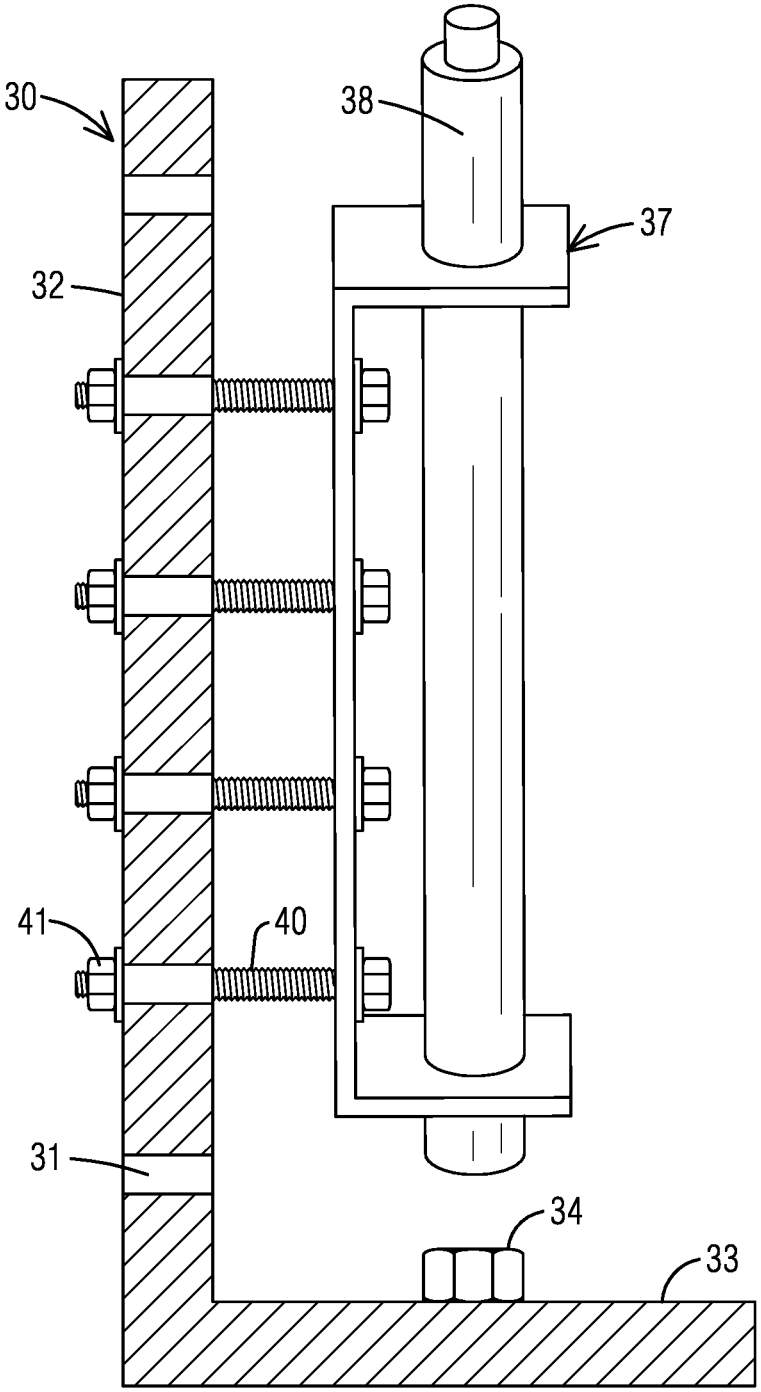
FIG. 5 is an elevation of the view of the rifle barrel jig of FIG. 4 holding a barrel therein mounted to a drill press mount.

In FIGS. 4 and 5, the process of making a barrel gas port in a barrel in accordance with the present invention along with the barrel holding the jig used in the process are illustrated. A custom right angled fixture 30 for a drill press mount or CNC fixture has a plurality of parallel angled slots in the upright portion 32 of the fixture 30. The flat bottom drill table mounting section 33 can be seen having a plurality of bolts 34 for mounting the fixture 30 in position on a drill table under a drill 35 having a drill bit 36. A barrel holding jig 37 is shown having a barrel mounted therein. The barrel holding jig 37 has a plurality of threaded fasteners 40, such as bolts, passing therethrough which can extend through the parallel angled slots 31 in the fixture 30 upright portion 32. The bolts can then be attached to the other side of the slots 31 and secured with nuts 41. As can be seen, the parallel angled slots 32 allow the bolts to be adjusted to position the barrel jig 37 at any desired angle for the drill 35 to drill a gas port at a specific angle with the port extending rearward from the barrel end at an angle to the rifle bore.

The process of making a firearm barrel with a rearwardly angled gas port 11 of FIG. 2 for a gas operated firearm includes first selecting a barrel 38 for a gas operated firearm which has a bore 13 therethrough from the muzzle 14 to the chamber 17. A firearm barrel drill jig 37 is selected for holding a barrel 38 therein and a firearm barrel 38 attached therein. The firearm barrel drill jig 37 is adjustably attached at a predetermined angle to a drill press mount fixture 30 which is in turn mounted to a drill press table. A drill bit 36 of a predetermined size is selected for the drill press for drilling an angled gas port 11 of a predetermined size into said firearm barrel 38 held in the firearm barrel jig 37 attached to the drill press fixture 30. A gas port 11 is drilled into the firearm barrel 38 held in the firearm barrel drill jig 37 at a predetermined angle and bore size from adjacent the muzzle rearwardly toward the firearm barrel bore as shown in FIG. 2. This positions the gas port firearm bore opening a predetermined distance from the barrel muzzle. The rifle barrel is then removed from the barrel holding jig 37 and attached to a rifle where the gas port 11 is attached to a standard gas tube 15.

It should be clear at this time that a method and apparatus for a firearm barrel for a gas operated firearm or the like has been provided. However the present invention is not to be considered limited to the forms shown which are to be considered illustrative rather than restrictive.

I claim:

1. A process of making a firearm barrel for a gas operated firearm comprising the steps of:

selecting a barrel for a gas operated firearm having a bore therethrough and a muzzle at one end thereof;

selecting a firearm barrel drill jig for holding a barrel therein;

attaching a firearm barrel in said firearm drill jig;

adjustably attaching said firearm barrel drill jig at a predetermined angle to a drill press mount and placing said drill press mount on a drill press table;

selecting a drill bit of a predetermined size for said drill press for drilling an angled gas port of a predetermined size into said firearm barrel held in said firearm barrel jig attached to said drill press mount; and drilling a gas port into said firearm barrel held in said firearm barrel drill jig at a predetermined angle having a predetermined bore size from adjacent said muzzle rearwardly toward said firearm barrel bore to position said gas port firearm bore opening a predetermined distance from said barrel muzzle.

2. The process of making a firearm barrel in accordance with claim 1 in which said drill press mount has a plurality of angled slots for adjustably mounting said barrel drill jig thereto at a predetermined angle to said drill press mount.

3. The process of making a firearm barrel in accordance with claim 1 in which said drill press mount has a plurality of threaded fasteners extending through said angled slots and attached to said barrel drill jig for mounting said barrel drill jig thereto.

4. The process of making a firearm barrel in accordance with claim 1 in which said drill press mount is a generally L-shaped drill press mount having one surface attached to a drill press table.

5. The process of making a firearm barrel in accordance with claim 4 in which said drill press mount one surface is bolted to said drill press table.

* * * * *